United States Patent [19]

de Jong

[11] 4,043,236

[45] Aug. 23, 1977

[54] DEVICE FOR TRANSFORMING A SINGLE PRESSURE FORCE INTO SEPARATE PRESSURE FORCES

[75] Inventor: Arie de Jong, Zaltbommel, Netherlands

[73] Assignee: Perswerk de Jong B.V., Netherlands

[21] Appl. No.: 656,802

[22] Filed: Feb. 10, 1976

[30] Foreign Application Priority Data

Feb. 14, 1975 Netherlands ..... 7501729

[51] Int. Cl.[2] ..... B26D 5/12; B26F 1/14

[52] U.S. Cl. ..... 83/137; 83/378; 83/390; 83/639

[58] Field of Search ..... 83/137, 378, 390, 461, 83/636

[56] References Cited

U.S. PATENT DOCUMENTS

| | | | |
|---|---|---|---|
| 2,215,643 | 9/1940 | Gorham | 83/137 |
| 2,353,488 | 7/1944 | Mueller | 83/137 |
| 2,716,451 | 8/1955 | Taylor | 83/137 |
| 2,732,898 | 1/1956 | Taylor | 83/137 |
| 2,758,652 | 8/1956 | Novinger et al. | 83/137 X |
| 2,776,540 | 1/1957 | Kraujalis | 83/137 X |
| 2,983,176 | 5/1961 | Taylor | 83/138 |
| 2,986,057 | 5/1961 | Novak | 83/133 |

FOREIGN PATENT DOCUMENTS

| | | |
|---|---|---|
| 1,071,753 | 3/1954 | France |
| 1,204,557 | 8/1959 | France |
| 2,047,254 | 3/1971 | France |

*Primary Examiner*—Frank T. Yost
*Attorney, Agent, or Firm*—Bacon & Thomas

[57] ABSTRACT

A process and device for transforming a single pressure force into separate pressure forces in the processing of material, especially for energizing a punch and a stripper when holes of small dimensions are punched in material which is relatively thick with respect to these holes, wherein the separate pressure forces are directly dependent on each other and on the tensile strength of the material to be worked on.

6 Claims, 1 Drawing Figure

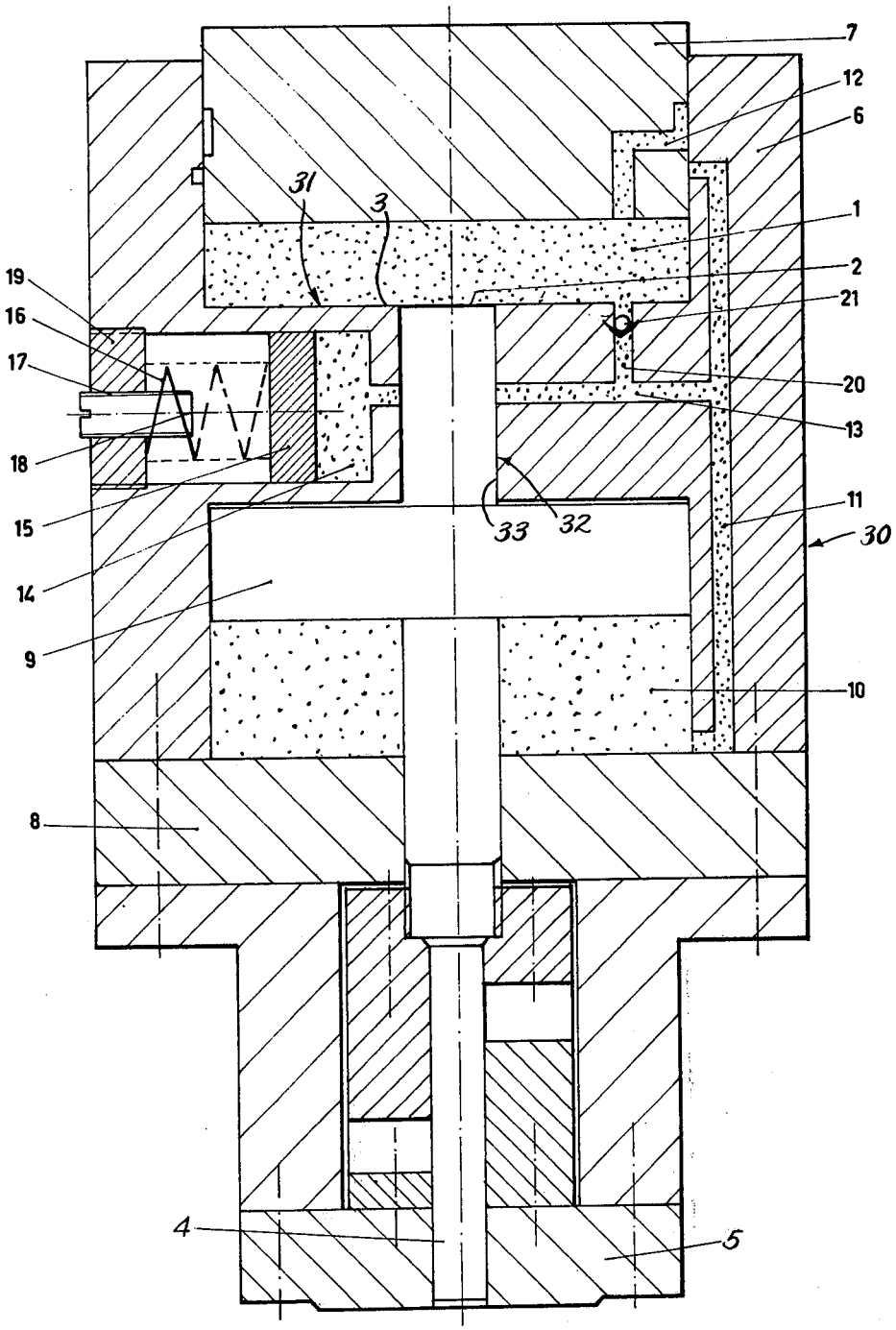
7
12
6
31
3
1
2
21
19
16
17
20
13
18
15
11
30
33
32
14
9
10
8
4
5

DEVICE FOR TRANSFORMING A SINGLE PRESSURE FORCE INTO SEPARATE PRESSURE FORCES

The invention relates to transforming a single pressure force into separate pressure forces in the processing of material, especially for energizing a punch and a stripper when holes of small dimensions are punched in material which is relatively thick with respect to these holes.

Until recently, a diameter which approximately equalled the thickness of the material to be punched was considered as the lower most value for the hole to be punched. When a punch with a round cutting edge was used, it was even possible to reach a diameter of circa 0.8 times the thickness of the material, provided at least that the thin part of the punch was kept as short as possible. The insufficient kink resistance of the free active part of the punch restricted the possibility to punch holes with a smaller diameter than the thickness of the material. Therefore, such small holes usually had to be drilled. The disadvantage of drilling, however, is that the production speed is low, whereas the effective life of a drill is rather short, so that after a relatively small number of holes the drill is worn so far that it must be replaced. With punches of unalloyed tool steel, on the contrary, 10,000 to 15,000 holes can be punched, whereas with punches of alloyed tool steel even up to 50,000 holes can be punched. Punching is therefore a very efficient method for making holes, so that attempts have been made to punch also holes, which are small with respect to the thickness of the material to be worked on. In the Handbuch der Stansereitechnik, V.E.B. Verlag, Berlin, 1959, pages 59 and 60, a method is described, with which it is possible to punch very small holes up to a diameter of the punch of at least circa 0.3 times the thickness of the material. For that purpose, a special guidance for the punch is used, whereas simultaneously the material to be punched is pressed firmly by means of a stripper or down-holder. With this method, the punch hole is not cut, but the material to be punched is rather pressed into the cutting plate hole. Because of the great down-holder- or stripper-force of circa 0.5 times the tensile strength of the material, a compression occurs in the cutting area, which facilitates the deformation process. In this way it is possible to punch holes with a diameter of 0.4 mm and also small slots with high surface quality of the punched holes in steel, brass and aluminium. The thickness of the material can be 1–20 mm.

In the described method the energizing of the punch and of the stripper takes place by means of a device, with which the punch pressure is obtained in a mechanical way, whereas the stripper pressure is also obtained in a mechanical way by means of springs. The pressure on the punch and the pressure on the stripper are independent of each other, whereas the pressure on the stripper is always independent of the working pressure. It is obvious that the punch pressure is dependent on the material to be punched. It has appeared, however, that also the stripper pressure must be dependent on the material when a good punching action is desired. In the known method, the stripper pressure must be set each time again in dependence on the material to be worked on. Besides, the stripper must be under pressure during the stripping for the withdrawal of the punch. This pressure, however, can be lower than during the punching, which is not the case with the known method and device, as the full stripping pressure is maintained during the punching and the withdrawal.

The purpose of the present invention is to provide a process, which does not have the disadvantages of the known method.

This is obtained according to the invention, in that the separate pressure forces are directly dependent on each other and on the tensile strength of the material to be worked on.

Because of the direct dependence on each other of both separate pressure forces, the stripping pressure in punching need not be set each time again in dependence on the material to be worked on.

The invention also relates to a device for carrying out the process according to the invention. The process according to the invention can be carried out in a mechanical way by means of a lever system, in which a lever provides the direct coupling between the two separate pressure forces.

The device according to the invention is characterized by a chamber for pressure medium, which chamber is closed at one side by a wall consisting of two parts, which are slidable with respect to each other and which can be connected to two parts, which are mobile with respect to each other, of a processing tool.

By increasing the pressure in the chamber for pressure medium, e.g. a liquid or air, this pressure can rise until the punching pressure is reached and the punch starts to penetrate into the material. As this pressure acts simultaneously on the two parts of the wall consisting of two parts, the pressure on the stripper also rises, so that the pressure on the stripper is fixed in a constant ratio punching pressure - stripping pressure. The punching pressure is dependent on the type of material to be punched and on the thickness of the material, whereas also the pressure on the stripper is therefore dependent on the type and the thickness of the material.

It is obvious that the wall consisting of two parts can be carried out as a piston consisting of two parts, which is provided slidable in a cylinder. Further, the pressure in the chamber can be generated by means of a pump, which pumps the pressure medium into said chamber, whereas the wall opposite the piston consisting of two parts is fixed to the side walls of the cylinder. Such a construction, however, is difficult to manufacture and functions less efficiently. In a preferable embodiment of the device according to the invention, it is carried out so that the wall consisting of two parts consists of a surrounding part and a central part, the surrounding part being one with the side walls connected thereto, whereas the wall opposite the wall consisting of two parts is formed by a piston. This construction is very simple, whereas it works simply too. The pressure in the chamber is generated by bringing beforehand a quantity of pressure medium in this chamber and by subsequently exerting a pressure force on the piston.

In these embodiments of the device according to the invention, there is always a constant ratio between the parts, which are slidable with respect to each other, of the wall consisting of two parts, and thus between the punching pressure and the stripping pressure during punching. At the withdrawal of the device according to the invention, and thus of the processing tool of the material to be worked on, both parts of the processing tool will be removed simultaneously from the workpiece, so that no pressure is exerted on the stripper during the stripping after the punching.

This is realized with a preferable embodiment of the device according to the invention, which is therefore characterized in that the side walls connected to the wall consisting of two parts, are prolonged beyond the first wall and are connected to an end wall, which is approximately parallel to said wall, prolongations of the parts of the first wall passing sealed through the end wall and being connectable to the parts of a processing tool, whereas the prolongation of one of the parts of the first wall is provided with a cross part with a surface directed to the end wall, which surface equals or almost equals the surface left free by the prolongation of the other part of the first wall, which cross part in an end position lies against the rear side of the first wall, so that a second chamber for pressure medium is formed by the side walls, the end wall and the cross part, which second chamber is connectable to the first chamber by means of a channel provided in a side wall and at least one valve, and which second chamber is connected to a buffer space.

During the punching, first the stripper and the punch are pressed simultaneously against the workpiece to be punched. When the pressure is so high that the punch is pressed through the material, the pressure medium in the second chamber can be evacuated into the buffer space. When the lowermost position of the punch is reached the valve, which forms the connection between the first and the second chamber, is opened, so that pressure medium can be guided from the first chamber to the second chamber through the channel in one of the side walls. Thus the pressure in the second chamber becomes equal to the pressure in the first chamber. But as the surface of the cross part in the second chamber is larger than the surface of the corresponding part of the wall consisting of two parts, a force will result, which withdraws the punch from the punched workpiece, whereas the stripper is still pressed against the workpiece.

In a preferable embodiment of this device, the prolongation of the part without cross part is one with the end wall, which is provided slidable in the side walls. This simplifies the construction of the whole.

Another simplification of the construction is obtained in a preferable embodiment according to the invention, in that the wall consisting of two parts consists of a surrounding part and a central part, the surrounding part being one with the side walls connected thereto, which themselves are connected to the side wall and form the prolongation of said part, the central part being provided with the cross part.

In principle, the valve, which is situated between the first and the second chamber, can be carried out at will and can even be operated manually from the outside. Preferably a valve is formed, however, by a channel in a piston opposite the wall consisting of two parts, which channel is connected to the channel in one of the side walls, when the piston is near its farthest position, which is in the first chamber for pressure medium. In this way the valve is opened automatically when the punch has penetrated through the material to be worked on, so that the punch is also withdrawn automatically when the single pressure force is applied.

In another preferable embodiment of the device according to the invention, the buffer space is provided from a side wall in the surrounding part of the wall consisting of two parts, and connected to the channel provided in one side wall, the variation of volume of this space being obtained by a spring-pressured piston, which is slidable in this space at a mainly right angle to the side wall. In this way a compact construction of the whole is obtained.

It is preferable in this embodiment that the largest volume of the buffer space is limited by an adjustable stop, which limits the movement of the piston towards the side wall. Thus the cross part on the prolongation, which is connectable to the punch, will not lie entirely against the end wall but at some distance therefrom. The pressure medium, which is guided through the channel in one side wall from the first to the second chamber, can therefore more easily come under the cross part.

Further, it is preferable that a feed back valve is provided in a channel between the channel provided in a side wall and the first chamber for pressure medium with the flow direction towards the first chamber. Thus it is possible to repel pressure medium, which was guided from the first into the second chamber, back into the first chamber for the withdrawal of the punch from the workpiece, the first valve between the first and the second chamber being open in this phase. This applied particularly when said first valve is formed by a channel in a piston situated opposite the wall consisting of two parts. During the withdrawal of said piston, said valve will namely be closed automatically, so that, in the absence of the feed back valve, the pressure medium could no longer be guided back from the second chamber to the first chamber.

The main advantage of the last-said embodiments of the device according to the invention is that during the stripping of the punch from the material, the force on the punch is smaller than during the punching, so that also the force on the stripper is much smaller than during the punching. This is obtained in particular by the buffer space. The pressure in the first pressure chamber rises only so much as is strictly necessary for the stripping, and not higher than is necessary for the material worked on and the thickness of the material.

In the above description of the device according to the invention, reference has been made to a chamber. It is obvious that this chamber can be subdivided in compartments which may be arranged apart from each other but which are connected to each other hydraulically. In a particular embodiment of the device according to the invention, the chamber consists of two or more cylinders, of which the wall of at least one cylinder can be connected to one of the parts of a processing machine, whereas the wall of at least one other cylinder can be connected to another part of the processing machine. In this embodiment, e.g. for punching, one cylinder can be connected to the punch, whereas four cylinders can be connected to the stripper. The advantage thereof is that sealing problems are easier to solve.

The invention will be explained hereinafter with reference to the drawing in which, by means of example, an embodiment of the device according to the invention is shown.

In the shown embodiment, the device according to the invention includes a main body 30 having a cylindrical side wall 6, and which contains at one end thereof a first or power chamber 1 for pressure medium, which chamber is closed at one side by a pressure end wall 31 that extends transversely of the main body 30, and which is comprised of two parts 2 and 3, which parts are slidable with respect to each other and which can be connected to two parts, which are mobile with respect to each other, of a processing tool. In the drawing, a punching tool is shown as the processing tool, and consists of a punch 4 and a stripper 5.

The pressure end wall 31, as has been noted, is comprised of the two parts 3 and 2. The part 3 is one with the cylindrical side wall 6 and surrounds the central part 2, the central part 2 being the end face of a piston rod 32 that is received within an axial bore 33 opening on the pressure wall 31. The first or power chamber 1 is closed by a power piston 7, received in the upper end of the main body 30 and which confronts the pressure wall 31.

The side wall 6 is prolonged beyond the pressure wall 31, and is connected to an end plate 8, which extends approximately parallel to said pressure wall. The piston rod 32 carrying the pressure wall part 2 is prolonged through said end plate 8, and includes a cross part or enlarged retraction piston 9 which is slidable relative to the side wall 6, and which in the initial position of the operation lies against the underside of the pressure wall 31. In this way a second or retraction chamber 10 for pressure medium is formed by the enlarged piston 9, the side wall 6 and the end plate 8. The second or retraction chamber 10 is aligned with the first or pressure chamber 1 on the axial bore 33 and is connected via a channel 11 to the first chamber 1. The connection is established when the power piston 7 approaches its lowermost position, so that a channel 12 provided in said piston 7 is connected to the channel 11. From the channel 11, a channel 13 is branched, which is connected to a buffer space 14 provided in the main body 30. The variation of volume of said buffer space 14 is obtained by means of a buffer piston 15, which is spring-pressured in the usual way by a spring 16. The range of movement of the buffer piston 15 is limited by a stop 18, which can be axially adjusted by means of a thread or the like. Preferably, the stop 18 can be a short pipe, in which the piston rod (not shown) of the buffer piston 15 is slidable. The buffer piston 15 itself then touches the end of said pipe 18. The pipe 18 is made adjustable by means of thread 17, with which said pipe can be screwed in a block or plate 19, which is secured in the side wall 6 of the device. It is obvious that the stop can also be carried out in a different way.

From the channel 13 is branched a channel 20, in which a one way feed back valve 21 is provided, said channel 20 debouching into the first chamber 1.

The device according to the invention works as follows. The drawing shows the device in its initial position, in which the end plate 8 is connected in a usual way to the stripper 5, whereas the piston rod 32 carrying the wall part 2 is connected in a usual way to the punch 4. By exerting a force on the power piston 7, a pressure occurs in the first or power chamber 1, so that separate pressure forces are exerted on the wall parts 2 and 3, which pressure forces on the one hand are transmitted directly to the punch 4 and on the other hand via the side wall 6 and the end wall 8 to the stripper 5. The pressure rises until the punch 4 carries out the punching operation. By this exerted pressure, also the pressure on the stripper 5 is determined. Because of the downward movement of the punch 4, also the power piston 7 moves further into the first or power chamber 1. The pressure medium is then evacuated from the second chamber 10 into the buffer space 14 via the channels 11 and 13. As the pressure in the first or power chamber 1 is higher than in the second chamber 10, the feed back valve 21 will remain closed. When the punch 4 has passed through the material, the pressure in the first or power chamber 1 disappears. When the punch 4 has reached its lowermost position, which position is adjustable by means of the stop 18, the power piston 7 reaches a position, in which the channel 12 in the piston 7 is connected to the channel 11 in the side wall 6. Thus pressure medium is pressed from the first or power chamber 1 into the second chamber 10, so that the pressure in the chamber 1 equals the pressure in the chamber 10. Because of the difference in surface area of the wall part 2 formed by the end of the piston rod 32 and the surface area of the enlarged retracting piston 9 in, respectively, the chambers 1 and 10, and because of the renewed rise of pressure caused by the movement of the power piston 7, the punch 4 will be pressed out of the material, whereas the stripper remains pressed against the material under the desired stripping pressure. As the stripping pressure during the stripping is much lower than the pressure on the stripper during the punching, the risk of wear of the punch during the stripping is very small.

When the single pressure force on the power piston 7 decreases, which means a drop of the pressure in the first or power chamber 1, the spring-pressured buffer piston 15 will press the pressure medium from the buffer space 14 through the feed back valve 21 to the chamber 1. The device is then back in its initial position.

Although the invention has been described for punching holes of small dimensions in material which is thick with respect to these holes, the invention is not restricted to this application. In principal, the invention can be used for other operations, such as e.g. cutting and deep-drawing of material.

In the above, mainly the transformation of a single pressure force into two separate pressure forces has been discussed. It is obvious, however, that the invention can also be used for the transformation of a single pressure force into more than two pressure forces. For that purpose, the chamber of the device must be closed at one side by a wall consisting of more than two parts.

I claim:

1. In a punching apparatus:

a main body having a first chamber and a second chamber connected by an axial bore, said axial bore opening on an end wall of said first chamber;

a power piston received in said first chamber, and movable toward and away from said end wall;

a piston rod received within said axial bore, and having a retraction piston thereon slidably received within said second chamber;

punch means arranged to be operated by said piston rod upon downward movement thereof, to engage a workpiece;

stripper means carried by said main body on the lower end thereof, and engageable with said workpiece;

means defining a buffer chamber, said buffer chamber containing a slidably mounted buffer piston, and means urging said buffer piston toward one end wall of said buffer chamber;

first passage means connected with the region of said second chamber beneath said retraction piston;

second passage means connecting said first passage means with the region of said buffer chamber beneath said buffer piston;

third passage means connecting said seond passage means with the region of said first chamber beneath said power piston, and including a one-way valve arrangement to permit flow only from said second passage means to said first chamber; and fourth passage means connecting said first passage means with said first chamber, and including valve means arranged to open only after said power piston has moved a predetermined distance within said first chamber toward said end wall;

said first chamber beneath said power piston, said second chamber beneath said retraction piston, said buffer chamber beneath said buffer piston, and said passages being arranged to receive an operating fluid, whereby when pressure is initially placed on said power piston to move said power piston toward said end wall of said first chamber said punch means and said stripper means will be engaged with said workpiece with separate pressure forces that are directly dependent on each other and on the strength of said workpiece, said valve means of said fourth passage means opening in response to further movement of said power piston occurring after said punch means penetrates said workpiece to operate said retraction piston for retracting said punch means while said stripper means remains engaged with said workpiece.

2. In a punching apparatus as recited in claim 1, wherein said retraction piston has a larger diameter than said piston rod, and said piston rod has a smaller diameter than said power piston, said first and second chambers having approximately the same diameters.

3. In a punching apparatus as recited in claim 1, wherein said buffer chamber is also formed in said main housing, and wherein said means urging said buffer piston toward one end wall of said buffer chamber is a spring.

4. In a punching apparatus as recited in claim 1, wherein said fourth passage means includes a first channel formed in said main housing and terminating at one end in an opening in the sidewall of said first chamber, and wherein said valve means comprises a second channel carried by said power piston, one end of said second channel opening on the sidewall of said power piston and being alignable with said one end of said first channel after said power piston has moved a predetermined distance toward said first chamber end wall, and the other end of said second channel opening into said first chamber beneath said power piston.

5. In a punching apparatus as recited in claim 4, wherein said first, and second and said third passage means are also formed as channels in said main body.

6. In a punching apparatus as recited in claim 1, including additionally: adjustable stop means for limiting the distance said buffer piston can move away from said end wall of said buffer chamber.

* * * * *